US010309693B2

(12) United States Patent
Zaynulin et al.

(10) Patent No.: US 10,309,693 B2
(45) Date of Patent: Jun. 4, 2019

(54) THERMAL ENERGY SYSTEM AND METHOD OF OPERATION

(75) Inventors: Dmitriy Zaynulin, London (GB); Graeme Ogilvie, Knaresborough (GB); Kevin Stickney, Tiddington (GB); Gregory Davis, London (GB)

(73) Assignee: ERDA MASTER IPCO LIMITED, St. Helier, Jersey (GB)

( * ) Notice: Subject to any disclaimer, the term of this patent is extended or adjusted under 35 U.S.C. 154(b) by 189 days.

(21) Appl. No.: 14/003,726

(22) PCT Filed: Mar. 8, 2012

(86) PCT No.: PCT/EP2012/054044

§ 371 (c)(1),
(2), (4) Date: Feb. 18, 2014

(87) PCT Pub. No.: WO2012/120097

PCT Pub. Date: Sep. 13, 2012

(65) Prior Publication Data

US 2014/0150475 A1 Jun. 5, 2014

(30) Foreign Application Priority Data

Mar. 8, 2011 (GB) ..... 1103916.1

(51) Int. Cl.
*F25B 6/00* (2006.01)
*F25B 9/00* (2006.01)
(Continued)

(52) U.S. Cl.
CPC ..... *F25B 9/008* (2013.01); *F25B 6/00* (2013.01); *F25B 6/04* (2013.01); *F25B 25/005* (2013.01);
(Continued)

(58) Field of Classification Search
CPC ..... F25B 2313/002; F25B 6/00; F25B 6/02; F25B 6/04; F25B 2313/02531; F25B 2313/02541
(Continued)

(56) References Cited

U.S. PATENT DOCUMENTS 2,461,449 A 2/1949 Smith et al.
2,637,531 A 5/1953 Davidson
(Continued)

FOREIGN PATENT DOCUMENTS

CA 2155667 8/1994
CH 649623 A5 5/1985
(Continued)

OTHER PUBLICATIONS

Machine Translation of JP 08-86528 to Kagami (Kagami), Espacenet, Apr. 2, 1996, all.*
(Continued)

*Primary Examiner* — Filip Zec
(74) *Attorney, Agent, or Firm* — Hamilton, Brook, Smith & Reynolds, P.C.

(57) ABSTRACT

A thermal energy system comprising a first thermal system in use having a cooling demand, and a heat sink connection system coupled to the first thermal system, the heat sink connection system being adapted to provide selective connection to a plurality of heat sinks for cooling the first thermal system, the heat sink connection system comprising a first heat exchanger system adapted to be coupled to a first remote heat sink containing a working fluid and a second heat exchanger system adapted to be coupled to ambient air as a second heat sink, a fluid loop interconnecting the first thermal system, the first heat exchanger system and the second heat exchanger system, at least one mechanism for selectively altering the order of the first heat exchanger
(Continued)

system and the second heat exchanger system in relation to a fluid flow direction around the fluid loop, and a controller for actuating the at least one mechanism. An alternative embodiment has a heating demand and uses heat sources.

38 Claims, 7 Drawing Sheets

(51) Int. Cl.

| | |
|---|---|
| ***F25B 6/04*** | (2006.01) |
| ***F25B 41/04*** | (2006.01) |
| ***F25B 49/02*** | (2006.01) |
| ***F25B 25/00*** | (2006.01) |
| ***F25B 27/00*** | (2006.01) |
| ***F25B 30/02*** | (2006.01) |

(52) U.S. Cl.
CPC ..... *F25B 27/00* (2013.01); *F25B 30/02* (2013.01); *F25B 41/04* (2013.01); *F25B 49/02* (2013.01); *F25B 2309/061* (2013.01); *F25B 2339/047* (2013.01); *F25B 2400/22* (2013.01)

(58) Field of Classification Search
USPC ..... 62/260, 196.4
See application file for complete search history.

(56) References Cited

U.S. PATENT DOCUMENTS 3,168,337 A 2/1965 Johnson et al.
3,986,362 A 10/1976 Baciu
4,022,025 A 5/1977 Greene
4,044,830 A 8/1977 Van Huisen
4,062,489 A 12/1977 Henderson
4,134,462 A 1/1979 Clay
4,165,619 A 8/1979 Girard
4,392,531 A 7/1983 Ippolito
4,444,249 A * 4/1984 Cady ..... F28D 15/0233 126/629
4,538,673 A 9/1985 Partin et al.
4,657,076 A 4/1987 Tsutsumi et al.
4,693,089 A 9/1987 Bourne et al.
4,711,094 A 12/1987 Ares et al.
5,081,848 A * 1/1992 Rawlings ..... E01C 11/26 165/45
5,224,357 A 7/1993 Galiyano et al.
5,244,037 A 9/1993 Warnke
5,272,979 A 12/1993 Wiggs
5,339,890 A 8/1994 Rawlings
5,372,016 A 12/1994 Rawlings
5,390,748 A 2/1995 Goldman
5,394,950 A 3/1995 Gardes
5,461,876 A * 10/1995 Dressler ..... F24J 3/083 237/2 B
5,477,703 A 12/1995 Hanchar et al.
5,477,914 A 12/1995 Rawlings
5,477,915 A 12/1995 Park
5,495,723 A 3/1996 MacDonald
5,548,957 A 8/1996 Salemie
5,704,656 A 1/1998 Rowe
5,765,380 A * 6/1998 Misawa ..... F04C 18/3446 62/210
5,822,990 A 10/1998 Kalina et al.
5,875,644 A 3/1999 Ambs et al.
5,992,507 A 11/1999 Peterson et al.
6,158,466 A 12/2000 Riefler
6,220,339 B1 4/2001 Krecke
6,250,371 B1 5/2001 Amerman et al.
6,688,129 B2 2/2004 Ace
6,775,996 B2 8/2004 Cowans
6,848,506 B1 2/2005 Sharp et al.
7,028,478 B2 4/2006 Prentice, III
7,178,337 B2 2/2007 Pflanz
7,228,696 B2 * 6/2007 Ambs ..... F25B 13/00 62/260
7,264,067 B2 9/2007 Glaser et al.
7,407,003 B2 8/2008 Ross
7,571,762 B2 8/2009 Ross
7,647,773 B1 1/2010 Koenig et al.
9,261,297 B2 * 2/2016 Guldali ..... F25B 5/04
9,316,421 B2 * 4/2016 Tanaka ..... F25B 41/04
9,360,236 B2 6/2016 Stewart et al.
9,556,856 B2 1/2017 Stewart et al.
9,915,247 B2 3/2018 Stewart et al.
2003/0024685 A1 2/2003 Ace
2003/0221436 A1 12/2003 Xu
2004/0168460 A1 * 9/2004 Briley ..... A63C 19/10 62/260
2004/0206085 A1 10/2004 Koenig et al.
2005/0006049 A1 1/2005 Ross
2005/0061472 A1 3/2005 Guynn et al.
2006/0064281 A1 3/2006 Nagano et al.
2006/0101820 A1 5/2006 Koenig et al.
2006/0168979 A1 8/2006 Kattner et al.
2007/0023163 A1 2/2007 Kidwell
2007/0044494 A1 * 3/2007 Ally ..... C09K 5/063 62/260
2007/0209380 A1 * 9/2007 Mueller ..... F25B 47/025 62/260
2009/0084518 A1 4/2009 Panula et al.
2010/0288465 A1 11/2010 Stewart et al.
2011/0067436 A1 * 3/2011 Lee ..... F24D 5/12 62/513
2011/0100586 A1 5/2011 Yang
2011/0146317 A1 * 6/2011 Cline ..... F25B 7/00 62/238.7
2011/0197599 A1 8/2011 Stewart et al.
2011/0265989 A1 * 11/2011 Alexandersson ..... E21B 33/138 166/208
2011/0272117 A1 11/2011 Hamstra
2012/0090807 A1 * 4/2012 Stewart ..... F03G 7/04 165/45
2013/0037236 A1 * 2/2013 Saunier ..... F24D 3/18 165/45
2014/0299291 A1 10/2014 Stewart et al.

FOREIGN PATENT DOCUMENTS

CN 1 731 041 B 2/2006
CN 1854649 A 11/2006
DE 27 31 178 A1 1/1979
DE 2850865 A1 6/1980
DE 29 19 855 A1 11/1980
DE 3018337 11/1980
DE 8032916 12/1980
DE 29 28 893 A1 1/1981
DE 3009572 A1 9/1981
DE 3048870 7/1982
DE 3114262 11/1982
DE 31 48 600 A2 7/1983
DE 3514191 A1 10/1986
DE 3600230 A1 7/1987
DE 37 35 808 A1 5/1988
DE 19728637 C1 3/1999
DE 203 03 484 U1 7/2004
DE 102009023142 A1 12/2010
EP 0070583 1/1983
EP 1048820 11/2000
EP 1808570 7/2007
EP 2 290 304 A1 3/2011
EP 2385328 A2 11/2011
FR 2456919 A 12/1980
FR 2817024 5/2002
GB 1496075 A 12/1977
GB 2045909 A 11/1980
GB 2434200 A 7/2007
GB 2450754 B 1/2012
GB 2482435 B 3/2012
GB 2482436 B 3/2012
JP 50022949 A 3/1975
JP 57058024 4/1982

(56) References Cited

FOREIGN PATENT DOCUMENTS

| | | | |
|---|---|---|---|
| JP | 62000741 | A | 1/1987 |
| JP | 55134264 | A | 10/1989 |
| JP | H08506652 | | 7/1996 |
| JP | 09060985 | A | 3/1997 |
| JP | 2001-183030 | A | 7/2001 |
| JP | 2001183030 | | 7/2001 |
| JP | 2005-098594 | A | 4/2005 |
| JP | 2005098594 | | 4/2005 |
| JP | 2006-118851 | A | 5/2006 |
| JP | 2006258406 | A | 9/2006 |
| JP | 2006-292310 | A | 10/2006 |
| JP | 2006292310 | | 10/2006 |
| JP | 2007024342 | A | 2/2007 |
| JP | 2008-292044 | A | 12/2008 |
| JP | 2009287912 | A | 12/2009 |
| WO | WO 82/02935 | A | 9/1982 |
| WO | WO 83/01272 | A | 4/1983 |
| WO | WO 94/18510 | A1 | 8/1994 |
| WO | WO 01/42721 | A | 6/2001 |
| WO | WO 03/069240 | A | 8/2003 |
| WO | WO 2007/097701 | A | 8/2007 |
| WO | WO 2008/034970 | A1 | 3/2008 |
| WO | WO 2009/006794 | A1 | 1/2009 |
| WO | WO 2009/007683 | A1 | 1/2009 |
| WO | WO 2009/007684 | A1 | 1/2009 |
| WO | WO 2010/053424 | A1 | 5/2010 |
| WO | WO 2011/017450 | A2 | 2/2011 |

OTHER PUBLICATIONS

International Search Report and Written Opinion of the International Searching Authority for PCT/GB2008/002269, entitled: Geothermal Energy System and Method of Operation, dated Oct. 16, 2008.

Great Britain Search Report for GB 0713178.2, date of search Feb. 26, 2008.

International Search Report and Written Opinion of the International Searching Authority for PCT/GB2008/002274, entitled: Geothermal Energy System and Method of Operation, dated Oct. 16, 2008.

Great Britain Search Report for GB 0713177.4, date of search Sep. 10, 2007.

Great Britain Examination Report for GB0713177.4, dated Sep. 28, 2010.

International Search Report and Written Opinion of the International Searching Authority for PCT/EP2012/054044, entitled: Thermal Energy System and Method of Operation, dated Jan. 17, 2013.

Combined Search and Examination Report for GB 1103916.1, dated Jul. 8, 2011.

Great Britain Search Report for GB0811013.2 dated Aug. 8, 2008.

Great Britain Search Report for GB0811013.2 dated Dec. 18, 2008.

International Search Report and the Written Opinion, International Application No. PCT/EP2012/072332, entitled: Orienting And Supporting A Casing Of A Coaxial Geothermal Borehole, dated Jul. 3, 2013.

Combined Search and Examination Report for GB 1119470.1, dated Mar. 13, 2012.

Combined Search and Examination Report for GB 1215986.9, dated Sep. 21, 2012.

Combined Search and Examination Report in GB 1218685.4, dated Nov. 6, 2012.

International Preliminary Report and Written Opinion, International Application No. PCT/EP2012/072332, entitled: Orienting And Supporting A Casing Of A Coaxial Geothermal Borehole, dated May 13, 2014.

* cited by examiner

THERMAL ENERGY SYSTEM AND METHOD OF OPERATION

This application is the U.S. National Stage of International Application No. PCT/EP2012/054044, filed Mar. 8, 2012, which designates the U.S., published in English, and claims priority under 35 U.S.C. §§ 119 or 365(c) to Great Britain Application No. 1103916.1, filed Mar. 8, 2011.

The present invention relates to a thermal energy system and to a method of operating a thermal energy system. The present invention has particular application in such a system coupled to or incorporated in a refrigeration system, most particularly a commercial scale refrigeration system, for example used in a supermarket. The present invention also has wider application within areas such as centralised cooling and heating systems and industrial refrigeration and or process heating.

Many buildings have a demand for heating and or cooling generated by systems within the building. For example, heating, ventilation and air conditioning (HVAC) systems may at some times require a positive supply of heat or at other times require cooling, or both, heating and cooling simultaneously. Some buildings, such as supermarkets, incorporate large industrial scale refrigeration systems which incorporate condensers which require constant sink for rejection of the heat. Many of these systems require constant thermometric control to ensure efficient operation. Inefficient operation can result in significant additional operating costs, particularly with increasing energy costs. A typical supermarket, for example, uses up to 50% of its energy for operating the refrigeration systems, which need to be run 24 hours a day, 365 days a year.

The efficiency of a common chiller utilizing a mechanical refrigeration cycle is defined by many parameters and features. However, as per the Carnot Cycle, the key parameter for any highly efficient refrigeration cycle is the quality of the energy sink which determines the Condensing Temperature (CT).

The CT is also closely related to the amount of the load supplied to the energy sink from the refrigeration cycle i.e. as the load increases, so more work will be required from the compressors to meet the required demand, and additional electrical energy to drive the compressors is converted into waste heat that is additional to the heat of absorption from the evaporators. This in turn results in higher load to the energy sink. Therefore, the lower the CT maintained, the less work required from the compressors FIG. 5 is graph showing the relationship between pressure and enthalpy in the refrigeration cycle for the refrigerant in a known refrigeration system which evaporates the liquid refrigerant in the refrigerator and then compresses and condenses the refrigerant.

The curve L which is representative of temperature defines therein conditions in which the refrigerant is in the liquid state. In the refrigerator the liquid refrigerant absorbs heat as it evaporates in the evaporator (at constant pressure). This is represented by line a to b in FIG. 5, with point b being outside the curve L since all the liquid is evaporated at this point the refrigerant is in the form of a superheated gas. Line a to b within curve L is representative of the evaporating capacity. The gaseous refrigerant is compressed by the compressor, as represented by line b to c. This causes an increase in gas pressure and temperature. Subsequently, the compressed gas is reduced in temperature to enable condensation of the refrigerant, in which a first cooling phase comprises initial cooling of the gas, as represented by line c to d and a second condensing phase comprises condensing of the gas to form a liquid, as represented by line d to e within the curve L. The sum of line c to e represents the heat of rejection. The liquid is then reduced in pressure by the compressor via an expansion device represented by line e to a, returning to point a at the end of that cycle.

Optionally, sub-cooling of the condensed liquid may be employed, which is represented by line e to f, and thereafter the sub-cooled liquid may be reduced in pressure via an expansion device, represented by line f to g, returning to point g at the end of that cycle. Such sub-cooling increases the evaporating capacity, by increasing the refrigerant enthalpy within the evaporator, which is from g to a, the inverse of the sub-cooling on the cooling and condensing line e to f.

The upper line of the refrigeration condensing cycle determines the effectiveness of the lower line, representing the evaporating capacity.

The smaller the increase in pressure between the evaporation line a to b (or g to b with sub-cooling) and the condensing line c to e (or c to f with sub-cooling), the greater the efficiency of the refrigeration cycle and the less the input energy to the compression pump.

There is a need in the art for a thermal energy system which can provide greater efficiency of the refrigeration cycle and reduced input energy to the compression pump throughout the year.

A variety of different refrigerants is used commercially. One such refrigerant is carbon dioxide, $CO_2$ (identified in the art by the designation code R744). The major advantage of this natural refrigerant is its low Global Warming Potential (GWP) which is significantly lower than leading refrigerant mixtures adopted by the refrigeration industry worldwide. For example, 1 kg of $CO_2$ is equal to GWP 1 while specialist refrigerants suitable for commercial and industrial refrigeration usually reach GWP 3800. In the manufacture and use of any commercial refrigeration apparatus, the inadvertent loss of pressurised refrigerant to ambient air is inevitable. For example, considering supermarket refrigeration systems, each average sized supermarket in the UK may lose more than hundred kilograms of refrigerant per year, and in other less developed countries the typical refrigerant loss is much higher. The use of $CO_2$ is also characterised by high operating pressures, which provide high energy carrying capability i.e. a higher than normal heat transport capacity per unit of refrigerant being swept around the refrigerant loop.

There is only one major disadvantage of the use of $CO_2$ as a refrigerant. Unlike synthetic refrigerants, it has low critical temperature point at 31.1° C. This means that any heat rejection from the $CO_2$ in relatively warm conditions will push this refrigerant into its transcritical region, i.e. condensation will not occur. Under such conditions, heat rejection will rely solely on so-called sensible heat transfer, resulting from cooling of the refrigerant, rather than latent heat transfer that would occur upon condensation of the refrigerant in different, sub critical, conditions. Such sensible heat transfer is a less effective way of heat rejection in comparison to condensation which relies upon latent heat release at the dew point.

As a result, not all the heat for condensation can be released which keeps $CO_2$ either in its transcritical state or gaseous state or part liquid part gaseous state and prevents the refrigeration cycle from operating reliably and effectively.

Modern refrigeration systems exist which can overcome that limitation by installing an additional pressure/temperature regulating valve after the heat rejection heat exchanger. This valve acts to create a pressure drop and retain the higher heat rejection pressure/temperature for the $CO_2$ refrigerant. The pressure drop and additional rejected heat to condensation is maintained by additional work/extraction by the compressor within the refrigeration cycle and constitutes an inefficiency. Such pressure drop and heat extraction is associated with a consequential loss of system COP, of up to 45%, and possibly more.

There is a further need for a refrigeration system which can incorporate carbon dioxide as a refrigerant and can function, consistently, at high efficiency.

The present invention aims to meet that need.

The present invention provides a thermal energy system comprising a first thermal system in use having a cooling demand, and a heat sink connection system coupled to the first thermal system, the heat sink connection system being adapted to provide selective connection to a plurality of heat sinks for cooling the first thermal system, the heat sink connection system comprising a first heat exchanger system adapted to be coupled to a first remote heat sink containing a working fluid and a second heat exchanger system adapted to be coupled to ambient air as a second heat sink, a fluid loop interconnecting the first thermal system, the first heat exchanger system and the second heat exchanger system, at least one mechanism for selectively altering the order of the first heat exchanger system and the second heat exchanger system in relation to a fluid flow direction around the fluid loop, and a controller for actuating the at least one mechanism.

The present invention also provides a method of operating a thermal energy system, the thermal energy system comprising a first thermal system, the method comprising the steps of;

(a) providing a first thermal system having a cooling demand;

(b) providing a first heat exchanger system coupled to a first remote heat sink containing a working fluid;

(c) providing a second heat exchanger system to be coupled to ambient air as a second heat sink;

(d) flowing fluid around a fluid loop interconnecting the first thermal system, the first heat exchanger system and the second heat exchanger system to reject heat simultaneously to the first and second heat sinks; and (e) selectively altering the order of the first heat exchanger system and the second heat exchanger system in relation to a fluid flow direction around the fluid loop.

The above aspects of the present invention particularly relate to a refrigeration system.

However, other aspects of the present invention also have applicability to other thermal energy systems, such as heating systems. In such a heating system, the thermal system has a heating demand (rather than a cooling demand) and heat sources are provided (rather than heat sinks), and a heat pump cycle is employed rather than a refrigeration cycle.

Accordingly, the present invention also provides a thermal energy system comprising a first thermal system in use having a heating demand, and a heat source connection system coupled to the first thermal system, the heat source connection system being adapted to provide selective connection to a plurality of heat sources for heating the first thermal system, the heat source connection system comprising a first heat exchanger system adapted to be coupled to a first remote heat source containing a working fluid and a second heat exchanger system adapted to be coupled to ambient air as a second heat source, a fluid loop concurrently interconnecting the first thermal system, the first heat exchanger system and the second heat exchanger system, at least one mechanism for selectively altering the order of the first heat exchanger system and the second heat exchanger system in relation to a fluid flow direction around the fluid loop, and a controller for actuating the at least one mechanism.

The present invention also provides a method of operating a thermal energy system, the thermal energy system comprising a first thermal system, the method comprising the steps of;

(a) providing a first thermal system having a heating demand;

(b) providing a first heat exchanger system coupled to a first remote heat source containing a working fluid;

(c) providing a second heat exchanger system to be coupled to ambient air as a second heat source;

(d) flowing fluid around a fluid loop interconnecting the first thermal system, the first heat exchanger system and the second heat exchanger system to extract heat simultaneously from the first and second heat sources; and (e) selectively altering the order of the first heat exchanger system and the second heat exchanger system in relation to a fluid flow direction around the fluid loop.

The present invention also has wider application within areas such as centralised cooling and heating systems and industrial refrigeration and or process heating demand.

Preferred features are defined in the dependent claims.

Embodiments of the present invention will now be described by way of example only, with reference to the accompanying drawings, in which.

Figure 1:
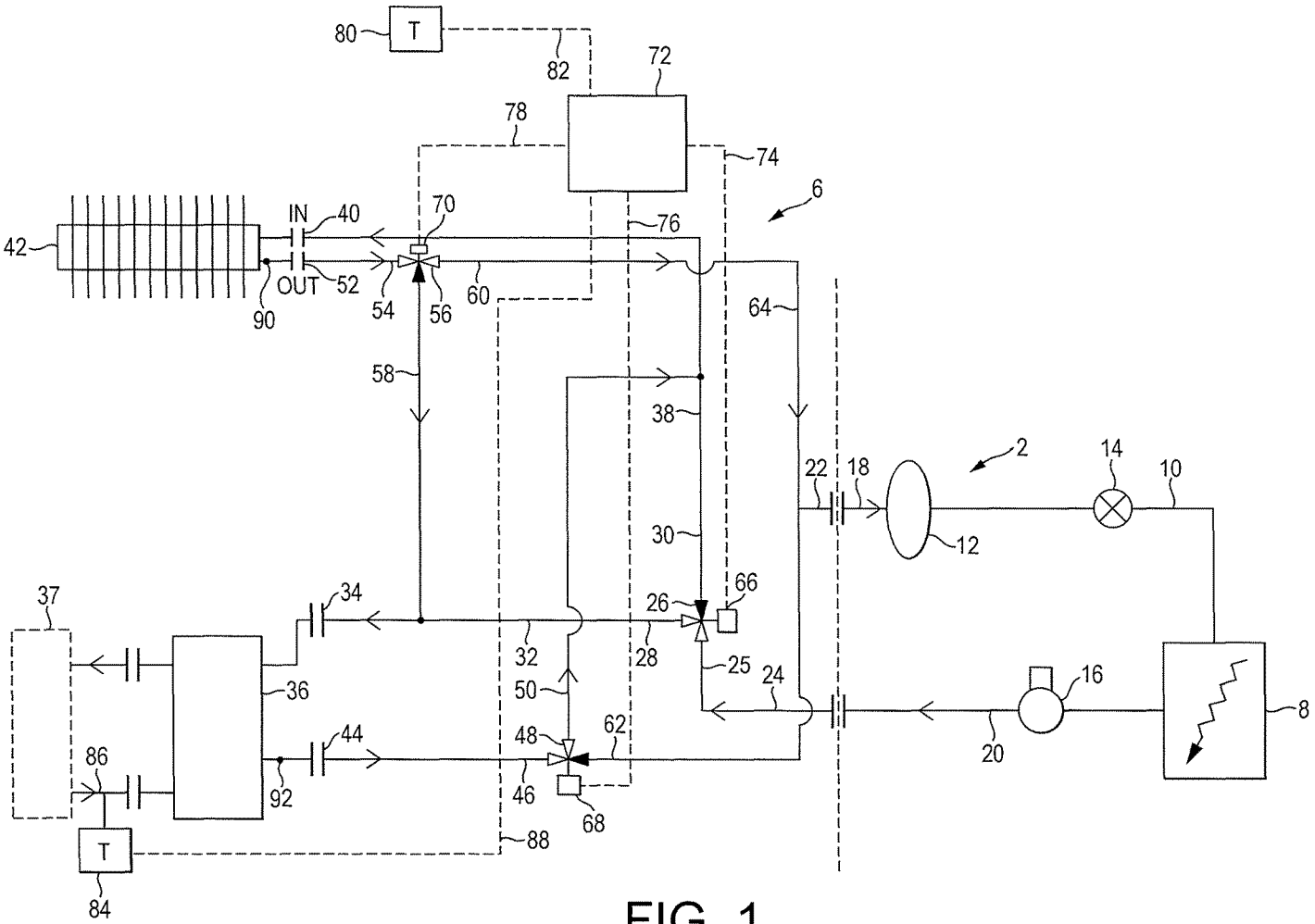
FIG. 1 is a schematic diagram of a thermal energy system including a refrigeration system of a supermarket in accordance with a first embodiment of the present invention, the thermal energy system being in a first mode of operation.
Figure 7:
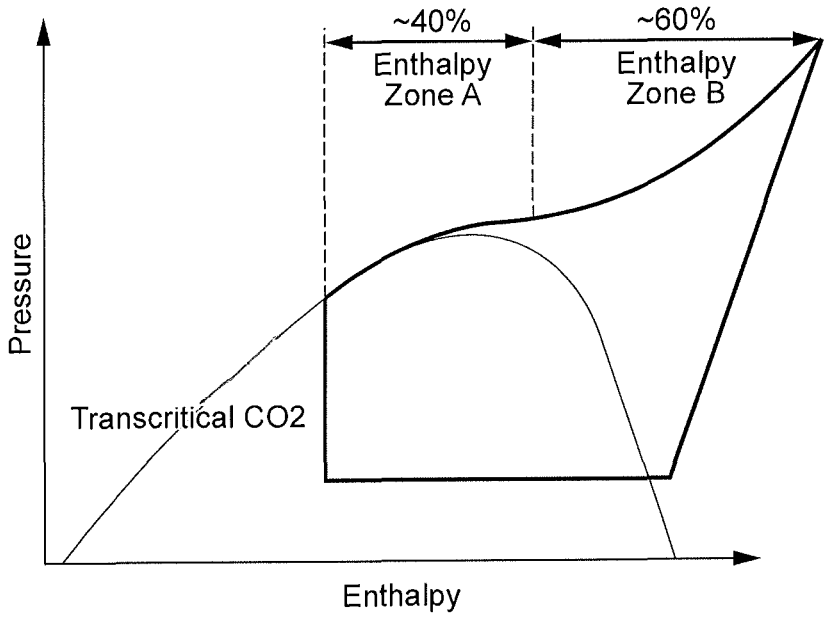
Figure 8:
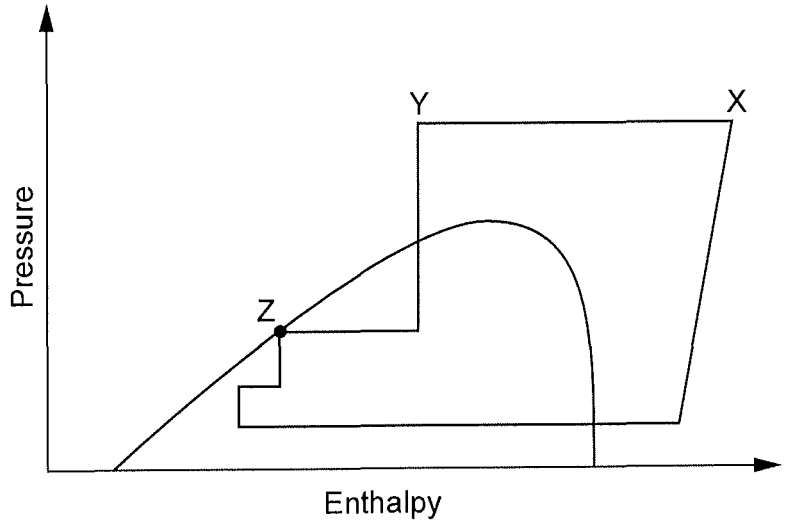
Figure 9:
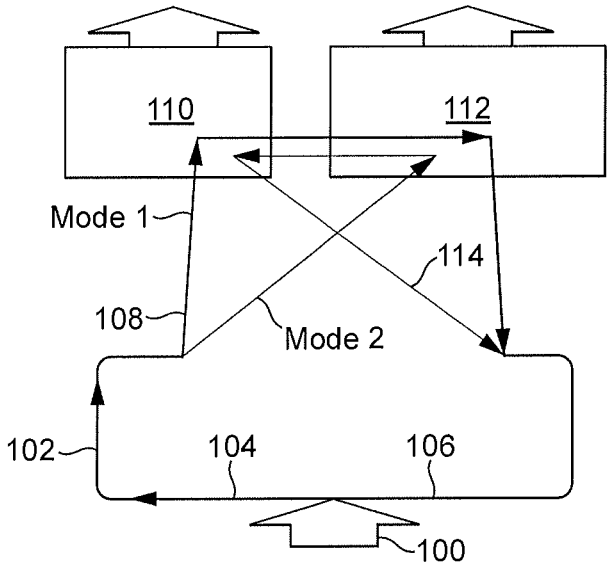
Figure 10:
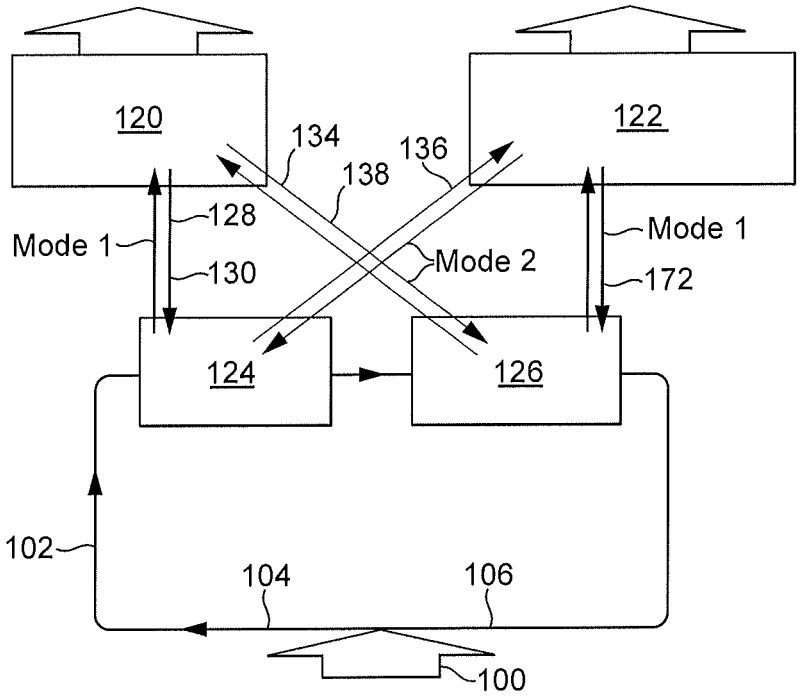
Figure 11:
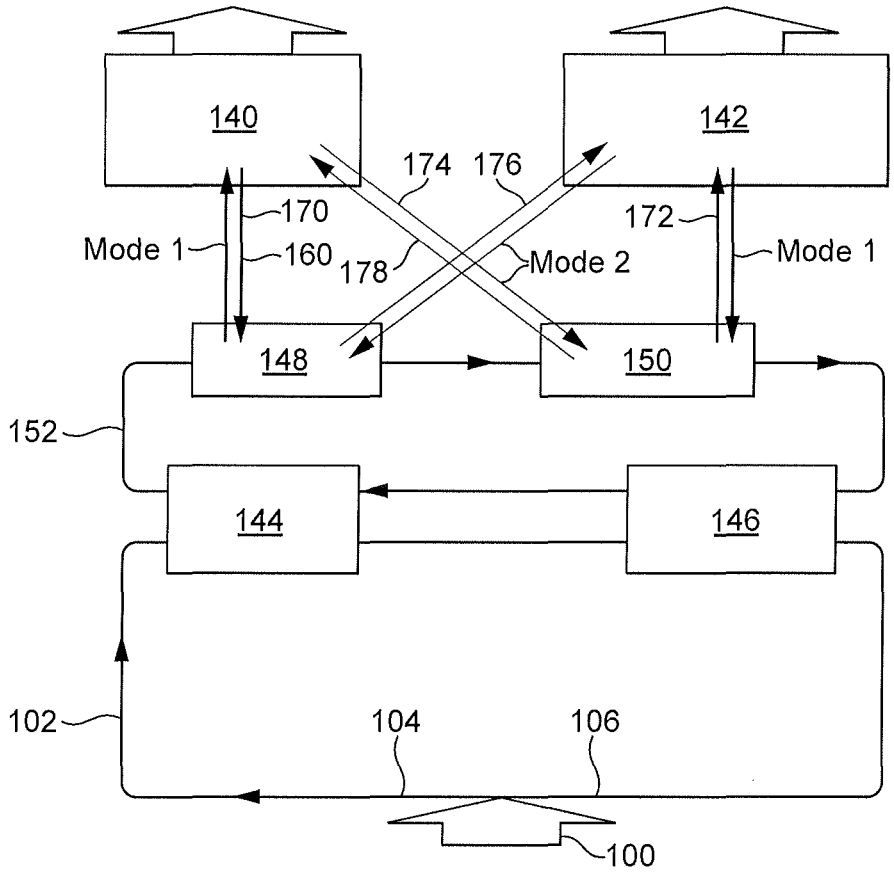

FIG. 7 which illustrates the upper section of a transcritical refrigeration cycle for $CO_2$ refrigerant in a graph showing the relationship between pressure and enthalpy in the refrigeration cycle for $CO_2$ refrigerant in the refrigeration system of the thermal energy system of FIG. 1 when used in a further embodiment of the present invention;

FIG. 8 is graph showing the relationship between pressure and enthalpy in the refrigeration cycle for $CO_2$ refrigerant in the refrigeration system of the thermal energy system of FIG. 1 when used in a further embodiment of the present invention; and FIGS. 9, 10 and 11 schematically illustrate respective refrigeration cycle loops according to further embodiments of the present invention.

Although the preferred embodiments of the present invention concern thermal energy systems for interface with refrigeration systems, other embodiments of the present invention relate to other building systems that have a demand for heating and/or cooling generated by systems within the building, for example heating, ventilation and air conditioning (HVAC) systems, which may require a positive supply of heat and/or cooling, or a negative supply of heat. Many of these systems, like refrigeration systems, require very careful and constant thermometric control to ensure efficient operation.

Referring to FIG. 1, there is shown schematically a refrigeration system 2, for example of a supermarket, coupled to a heat sink system 6. The refrigeration system 2 typically comprises a commercial or industrial refrigeration system which utilizes a vapour-compression Carnot cycle.

The refrigeration system 2 includes one or more refrigeration cabinets 8. The refrigeration cabinets 8 are disposed in a refrigerant loop 10 which circulates refrigerant to and from the cabinets 8. The refrigerant loop 10 includes, in turn going from an upstream to a downstream direction with respect to refrigerant flow, a receiver 12 for receiving an input of liquid refrigerant, an expansion valve 14 for controlling the refrigerant flow to the evaporator. One or more cabinets 8 for evaporating the liquid refrigerant, thereby cooling the interior of the cabinets 8 by absorbing the latent heat of evaporation of the refrigerant created by the extraction performance of the compressor 16 for compressing and condensing the refrigerant. The receiver 12 is connected to an input condensate line 18 from the condensing heat sinks 36, 42 and the compressor 16 is connected to an output discharge line 20 to the condensing heat sinks 36, 42.

The heat sink system 6 has an output line 22 connected to the input suction line 18 and an input line 24 connected to the output discharge line 20.

The input line 24 is connected to an input arm 25 of a first two-way valve 26 having first and second output arms 28, 30. The first output arm 28 is connected by a conduit 32 to an input 34 of a first heat exchanger system 36. The second output arm 30 is connected by a conduit 38 to an input 40 of a second heat exchanger system 42.

The first heat exchanger system 36 is connected to a remote heat sink 37 for heat rejection which is typically an external water source having a stable temperature such as aquifer water or a working fluid in an array of borehole heat exchangers of a geothermal energy system. The second heat exchanger system 42 employs ambient air as a heat sink for heat rejection. The second heat exchanger system 42 may be a condenser, gas cooler or sub-cooler heat exchanger. The two heat sinks generally have different temperatures, and, as described below, the two different temperatures are exploited to determine a desired mode of operation of the heat sink system 6 so as to maximize cooling efficiency, minimize input energy and reduce the capital and running costs of the combined integrated refrigeration and mechanical system.

Each mode of operation has a respective loop configuration in which a respective order of the heat exchangers within the loop configuration is selectively provided, thereby providing that the particular connection of each heat sink within the refrigeration cycle is selectively controlled.

The first heat exchanger system 36 has an output 44, in fluid connection with the input 34 within the heat exchanger system 36, connected to a first input arm 46 of a second two-way valve 48. The second two-way valve 48 has an output arm 50 connected to the conduit 38.

The second heat exchanger system 42 has an output 52, in fluid connection with the input 40 within the second heat exchanger system 42, connected to an input arm 54 of a third two-way valve 56. The third two-way valve 56 has a first output arm 58 connected to the conduit 32. The third two-way valve 56 has a second output arm 60 connected to the output line 22 and to a second input arm 62 of the second two-way valve 48 by a conduit 64.

The heat sink connection system is configured to provide substantially unrestricted flow of refrigerant between the heat sinks around the loop, so as substantially to avoid inadvertent liquid traps. For example, the heat sink connection system is substantially horizontally oriented.

Each of the first, second and third two-way valves 26, 48 56 has a respective control unit 66, 68, 70 coupled thereto for controlling the operation of the respective valve. The first control unit 66 selectively switches between the first and second output arms 28, 30 in the first two-way valve 26; the second control unit 68 selectively switches between the first and second input arms 46, 62 in the second two-way valve 48; and the third control unit 70 selectively switches between the first and second output arms 58, 60 in the third two-way valve 56.

Each of the first, second and third control units 66, 68, 70 is individually controlled by a controller 72 which is connected by a respective control line 74, 76, 78, or wirelessly, to the respective control unit 66, 68, 70.

The first heat exchanger system 36 has a first temperature sensor 84 mounted to sense a temperature of a heat sink, or a temperature related thereto, for example of a working fluid on a second side 86 of the first heat exchanger system 36, the first temperature sensor 84 being connected by a first data line 88 to the controller 72. A second ambient temperature sensor 80, for detecting the ambient temperature of the atmosphere, is connected by a second data line 82 to the controller 72.

It may be seen from the foregoing that the first, second and third two-way valves 26, 48 56 may be controlled so as selectively to control the sequence of refrigerant flow through the first and second heat exchanger systems 36, 42.

The first heat exchanger system 36 comprises a heat exchanger adapted to dissipate heat to a remote heat sink, such as a body of water, and aquifer on a closed-loop ground coupling system. The first heat exchanger system 36 may comprise a condensing heat exchanger such as a shell-and-tube heat exchanger, a plate heat exchanger or a coaxial heat exchanger. The remote heat sink includes an alternative cooling medium to ambient air, for example the ground.

The second heat exchanger system 42 comprises a heat exchanger adapted to dissipate heat to the ambient air in the atmosphere. The second heat exchanger system 42 may comprise a non-evaporative heat exchanger or an evaporative heat exchanger. The non-evaporative heat exchanger may, for example, be selected from an air condenser or dry-air cooler. The evaporative heat exchanger may, for example, be selected from an evaporative adiabatic air-condenser or condensing heat exchanger with a remote cooling tower.

The second ambient temperature sensor 80 detects the ambient temperature and thereby provides an input parameter to the controller 72 which represents the temperature state of the second heat exchanger system 42 which correlates to the thermal efficiency of the second heat exchanger system 42. Correspondingly, the first temperature sensor 84 detects the heat sink temperature, or a temperature related thereto, and thereby provides an input parameter to the controller 72 which represents the temperature state of the first heat exchanger system 36 which correlates to the thermal efficiency of the first heat exchanger system 36.

In a first selected operation mode the liquid refrigerant input on line 24 is first conveyed to the first heat exchanger system 36 and subsequently conveyed to the second heat exchanger system 42 and then returned to the line 22. In the first operation mode the second output arm 30 in the first two-way valve 26, the second input arm 62 in the second two-way valve 48, and the first output arm 58 in the third two-way valve 56 are closed.

In a second selected operation mode the liquid refrigerant input on line 24 is first conveyed to the second heat exchanger system 42 and subsequently conveyed to the first heat exchanger system 36. In the second operation mode the first output arm 28 in the first two-way valve 26, the output arm 50 in the second two-way valve 48, and the second output arm 60 in the third two-way valve 56 are closed.

The controller 72 is adapted to switch between these first and second modes dependent upon the input temperature on data lines 82, 88. The measured input temperatures in turn determine the respective thermal efficiency of the first heat exchanger system 36 and the second heat exchanger system 42. The sequence of the first heat exchanger system 36 and the second heat exchanger system 42 is selectively switched in alternation so that one constitutes a desuperheater or combined desuperheater-condenser and the other constitutes a condenser or sub-cooler, depending on conditions and application.

Figure 2:
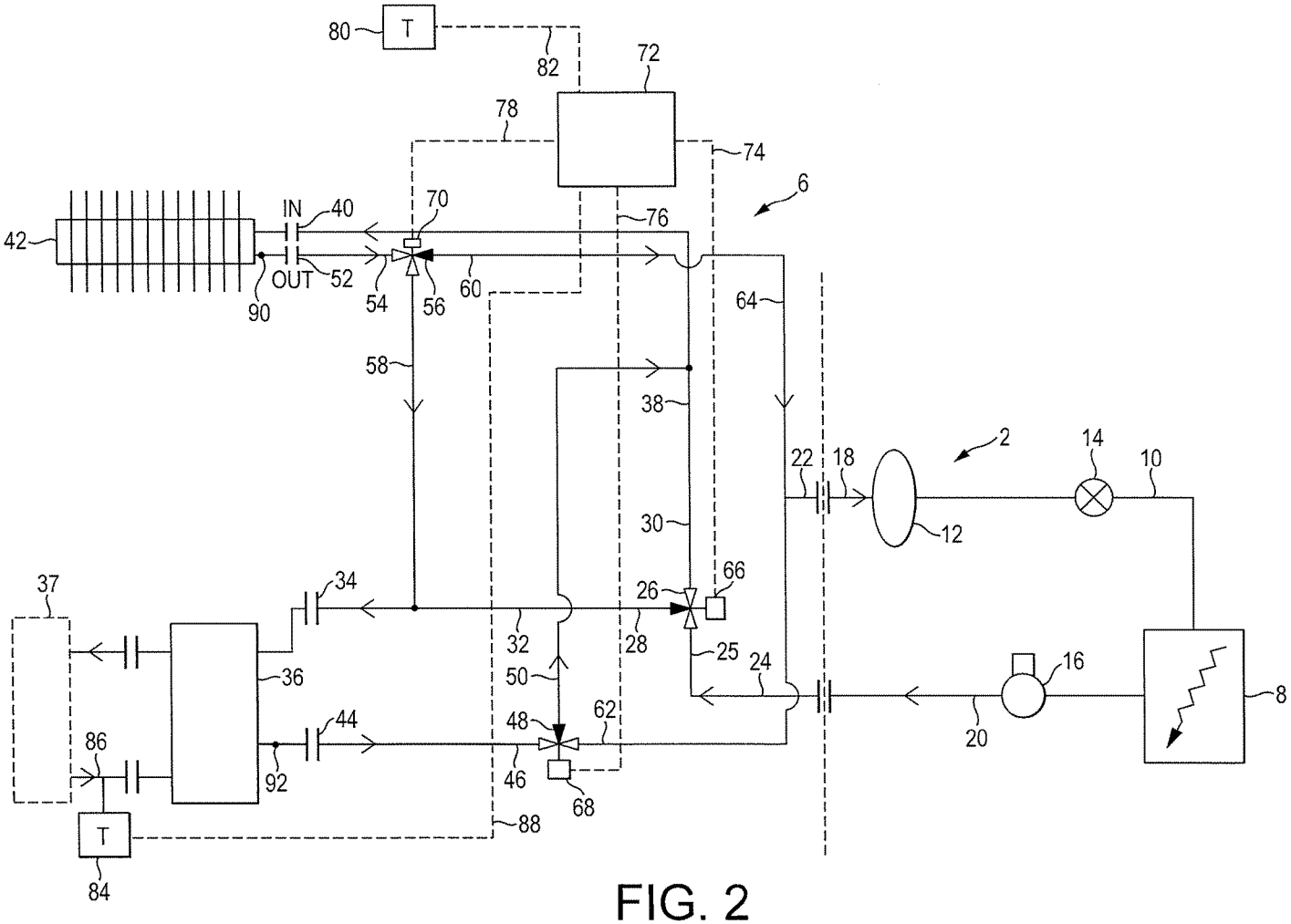
FIG. 2 is a schematic diagram of the thermal energy system of FIG. 1 in a second mode of operation.

In a winter (or low-ambient) mode, the first heat exchanger system 36 constitutes a desuperheater or combined desuperheater-condenser and the second heat exchanger system 42 constitutes the condenser or sub-cooler, as illustrated in FIG. 1. In a summer (or high-ambient) mode, the second heat exchanger system 42 constitutes the primary desuperheater or combined desuperheater-condenser and the first heat exchanger system 36 constitutes the condenser or sub-cooler, as illustrated in FIG. 2.

Figure 3:
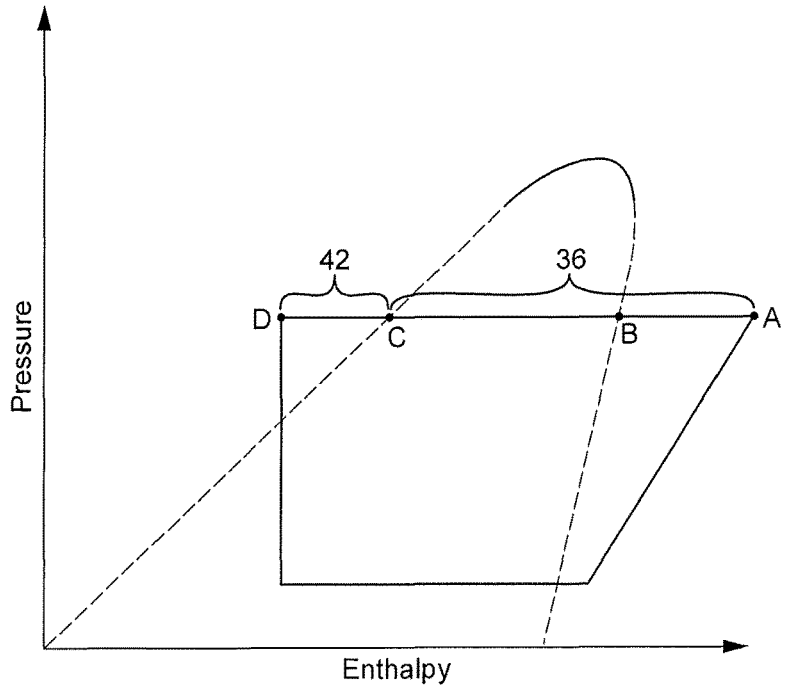
FIG. 3 is graph showing the relationship between pressure and enthalpy in the refrigeration cycle for the refrigerant in the refrigeration system of the thermal energy system of FIG. 1 in the first mode of operation.

FIG. 3 illustrates the low-ambient mode in a graph representing the relationship between pressure and enthalpy in the refrigeration cycle for the refrigerant in the refrigeration system 2 and the heat sink system 6. Line A-D represents the total heat of rejection (THR) when the refrigerant is cooled at constant pressure. At point A the refrigerant has been pressurized and heated by the compressor 16. Section A-B represents the enthalpy (as sensible heat) released by cooling of the refrigerant gas. Section B-C represents the enthalpy (as latent heat) released by condensing of the refrigerant gas to a liquid. Section C-D represents the enthalpy (as sensible heat) released by sub-cooling of the refrigerant liquid. In the low-ambient mode, the gas cooling and all or partial condensing stages of A-C are carried out in the first heat exchanger system 36 and any residual condensing stage of B-C or sub-cooling C-D for the refrigerant is carried out in the second heat exchanger system 42.

When the ambient (air temperature) is lower, the second heat exchanger system 42 efficiently serves a high cooling and condensing demand at relatively low temperatures during the cooling and condensing phase B-C. Accordingly, the initial high temperature cooling and condensing demand is served by the first heat exchanger system 36 which has a remote heat sink, such as an array or borehole heat exchangers. The subsequent lower temperature cooling demand is served by the second heat exchanger system 42 which rejects heat to ambient air.

The controller 72 switches the heat sink system 6 into the low-ambient mode when the input temperatures from the first temperature sensor 84 and the second ambient temperature sensor 80 meet particular thresholds which determine, by calculation in the controller 72, that the required total heat of rejection can be met most efficiently in that mode using lowest optimum condensing temperature of the refrigerant, and so minimum input energy.

The winter or low-ambient mode may be used at any time when the sensed temperatures meet those particular thresholds, not just in winter but also, for example, for night-time operation when there is a lower ambient temperature than during daytime.

Figure 4:
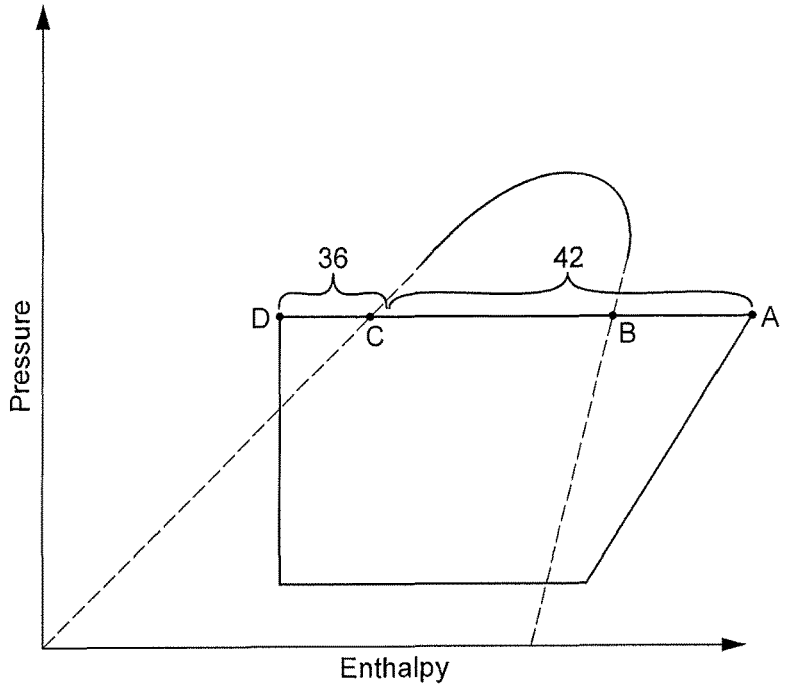
FIG. 4 is graph showing the relationship between pressure and enthalpy in the refrigeration cycle for the refrigerant in the refrigeration system of the thermal energy system of FIG. 1 in the second mode of operation.

FIG. 4 illustrates the summer or high-ambient mode in a similar graph representing the relationship between pressure and enthalpy in the refrigeration cycle for the refrigerant in the refrigeration system 2 and the heat sink system 6. Again, line A-D represents the total heat of rejection (THR) when the refrigerant is cooled at constant pressure. At point A the refrigerant has been pressurized by the compressor 16. Section A-B represents the enthalpy (as sensible heat) released by cooling of the refrigerant gas. Section B-C represents the enthalpy (as latent heat) released by condensing of the refrigerant gas to a liquid. Section C-D represents the enthalpy (as sensible heat) released by sub-cooling of the refrigerant liquid.

In the summer or high-ambient mode, the relatively high temperature gas cooling and all or partial condensing stages of A-C are carried out in the second heat exchanger system 42 and any residual condensing stage B-C or sub-cooling stage of C-D for the refrigerant is carried out in the first heat exchanger system 36. In the high-ambient mode, when the ambient (air temperature) is higher, the second heat exchanger system 42 is only able to efficiently serve cooling and condensing demand at relatively high refrigerant temperatures during the cooling and condensing phase A-C. Accordingly, the initial cooling and condensing demand is served by the second heat exchanger system 42 rejecting heat to ambient air. The residual cooling demand is served by the first heat exchanger system 36 which has a remote heat sink, such as an array or borehole heat exchangers.

The controller 72 switches the heat sink system 6 into the high-ambient mode when the input temperatures from the first temperature sensor 84 and the second ambient temperature sensor 80 meet particular thresholds which determine, by calculation in the controller 72, that the required total heat of rejection can be met most efficiently in that mode using lowest optimum condensing temperature of the refrigerant, and so minimum input energy. The summer or high-ambient mode may be used at any time when the sensed temperatures meet those particular thresholds, not just in summer but also, for example, for daytime operation when there is a higher ambient temperature than during night-time.

The switching between the winter and summer modes may be based on the determination of the relationship between, on the one hand, the temperature of the remote heat sink, which represents a first heat sink temperature for utilization by the first heat exchanger system 36 rejecting heat to the remote heat sink and on the other hand, the ambient air temperature, which represents a second heat sink temperature for utilization by the second heat exchanger system 42 rejecting heat to ambient air. For example, if the first heat sink temperature is higher than the second heat sink temperature (ambient air), then the winter mode is enabled, whereas if the second heat sink temperature (ambient air) is higher than the first heat sink temperature, then the summer mode is switched on. In an alternative embodiment, the switching may be triggered when the first and second heat sink temperatures differ by a threshold value, for example when the temperatures differ by at least 10 degrees Centigrade. As a more particular example, the winter mode may be selected when the ambient temperature is at least 10 degrees Centigrade lower than the fluid heat sink temperature. The selected threshold may be dependent on the particular heat sinks employed.

This switching between alternative modes provides effective use of the energy sinks and minimizes energy input into the system by maintaining lowest optimum condensing temperature of the refrigerant to achieve a lower total heat of rejection for any given cooling load. The most effective heat exchanger (or combination of heat exchangers) for achieving refrigerant condensing under the specific environmental conditions then prevalent can be employed automatically by the controller. In addition, when a remote heat sink such as a borehole system is employed, this may also enable a smaller borehole system, at reduced capital cost and running cost, to be required as compared to if a single borehole system was required to provide the total cooling and condensing capacity for the refrigeration system.

Figure 5:
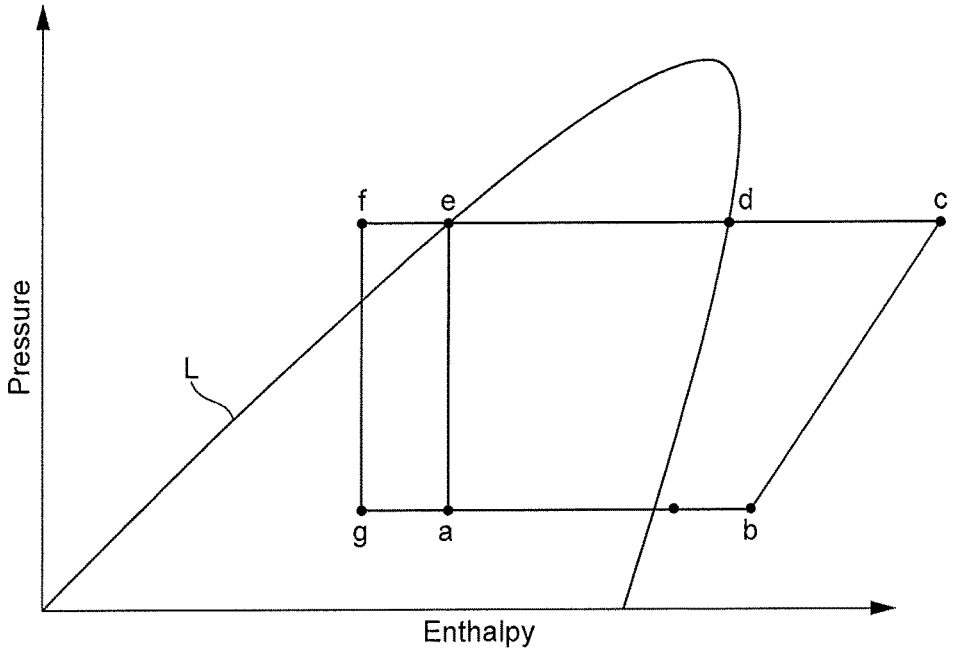
FIG. 5 is graph showing the relationship between pressure and enthalpy in the refrigeration cycle for the refrigerant in a known refrigeration system.
Figure 6:
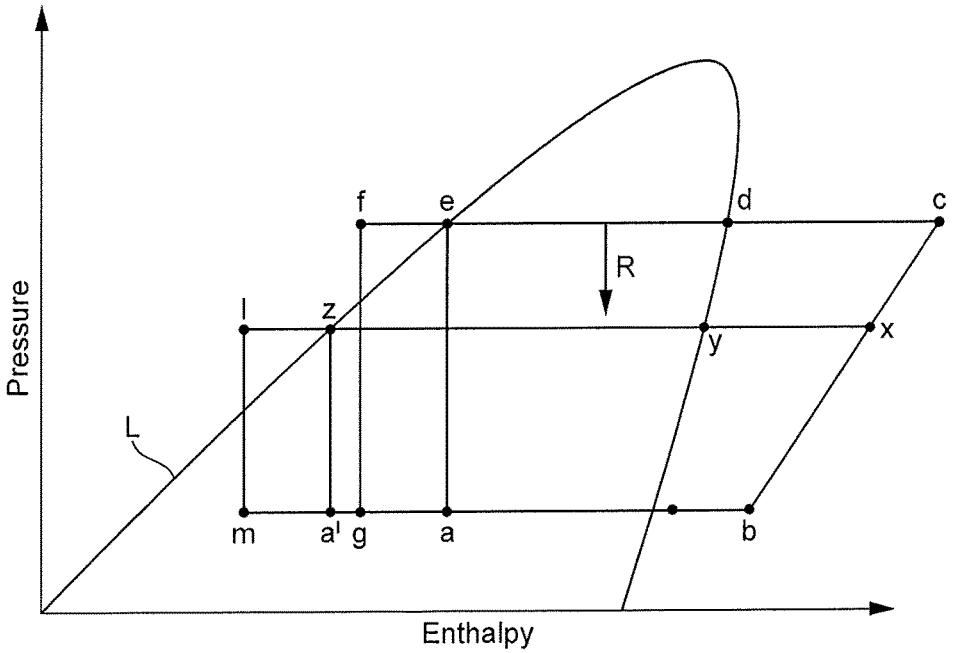
FIG. 6 is graph showing the relationship between pressure and enthalpy in the refrigeration cycle for the refrigerant in the refrigeration system of the thermal energy system of FIG. 1.

Referring now to FIG. 6, which is a modification of FIG. 5, in accordance with the present invention, the use of two heat sinks operating with different temperatures permits the upper cooling/condensing line to be made up of two sequential heat exchange operations, each associated with a respective heat exchanger which is operating at a high level of efficiency for the input parameters. This enables the upper cooling/condensing line to be lowered, towards the evaporation line. This in turn means that the compression pressure is reduced, thereby reducing the input energy to the compression pump.

In particular, in FIG. 6 the upper line is reduced in pressure, as shown by arrow R, to a line extending from point x at the upper end of the compression line, through point y at the intersection with the curve L, and to point z on the curve L and at the upper end of the expansion line. Line x to y represents enthalpy input, from the compression pump, to drive the system, which is less than the enthalpy input of line c to d of the known system of FIG. 5. There is therefore a saving in compressor power. In addition, the evaporating capacity is increased, represented by line a' to b, primarily within the curve L, as compared to line a to b of the known system of FIG. 5. Furthermore, there is an increased enthalpy, because there is a greater condensation, represented by line y to z, within the curve L as compared to line d to e of the known system of FIG. 5. The present invention may additionally offer or use sub-cooling, as represented by the points l and m, which further increases the evaporating capacity.

The present invention can utilize changes in seasonal ambient temperature relative to a remote heat sink to provide a selected combined cooling/condensation phase which can greatly increase the annual operating efficiency of the refrigeration system. Sub-cooling may also be able to be used without additional plant or running cost. Sub-cooling can also provide a substantial increase in cooling capacity without increasing the work required from the compressor, thereby increasing the COP of the refrigeration system. Accordingly, the use of an additional serially located heat sink to provide two sequential cooling/condensing phase portions can provide the advantage of additional sub-cooling below the minimum condensing temperature, increasing the evaporating capacity.

Ambient air has a lower specific heat than water-based cooling fluids. Accordingly, ambient air heat exchangers, particularly non-evaporative condensing ambient air heat exchangers, perform better under part-load conditions than heat exchangers arranged or adapted to dissipate heat to water-based cooling fluids. Therefore such an ambient air heat exchanger dissipates heat at higher discharge temperatures and or higher condensing temperatures due to a higher temperature difference ($\Delta T$) across the heat exchanger.

Evaporative ambient air heat exchangers are effective for heat rejection in the summer months due to high ambient temperature but have reduced effectiveness at lower ambient temperature and high humidity conditions. Accordingly, reversing the role of the ambient air heat exchanger to provide primary condensing in the summer mode and sub-cooling in the winter mode can improve the overall efficiency of the system.

The combined heat sink system can provide lower condensing throughout the annual cycle. The condensing temperature can be controlled to be the lowest available within the design constraints of the system. The combined heat sink system can provide a substantial increase in cooling capacity with reduced work form the compressor, thereby improving the COP of the system. Therefore the addition of a second heat sink, with the order and function within the refrigeration loop of the first and second heat sinks being alternated under selective control, can provide a condensing effect at a lower annual average temperature than would be practicably achievable using a single heat sink.

Sub-cooling may optionally be employed. A regulating valve to control sub-cooling, or alternatively a liquid receiver or expansion vessel, may be incorporated into the loop in the line between the two heat exchangers connected to remote heat sinks.

The system and method of the invention may use a variety of different refrigerants, which themselves are known in the art. The refrigerant may be a condensing refrigerant, typically used in commercial refrigeration devices, or a non-condensing refrigerant.

There are now described particular embodiments of the present invention employing carbon dioxide ($CO_2$) as the refrigerant in a transcritical refrigeration cycle.

The system can be employed using $CO_2$ refrigerant which provides a regime with higher pressures and temperatures (after discharge from the compressor) than with other conventional refrigerants. This regime results in a higher $\Delta T$ between the discharge refrigerant and the heat sink temperature interchange. This higher $\Delta T$ means that sensible heat transfer becomes substantially more effective. A traditional system using a gas cooler connected to ambient air as a heat sink, $CO_2$ condensation may not occur i.e. all heat transfer takes place as sensible heat transfer; and as the temperature of the $CO_2$ passing through the heat exchanger declines, the $\Delta T$ and the rate of sensible heat transfer likewise decline. Since $CO_2$ has a critical temperature of 31 C it is often impossible to reject the remaining sensible and latent heat of condensing into the cooling medium, which in turn reduces the cooling capacity of the refrigeration cycle.

Referring to FIG. 7, this illustrates a graph showing the relationship between pressure and enthalpy in the refrigeration cycle for $CO_2$ refrigerant in the refrigeration system of the thermal energy system of FIG. 1.

The thermal energy system of the invention can be configured and used to operate with $CO_2$ refrigerant in a transcritical refrigeration and also the sub critical cycle.

By providing that the initial heat exchanger in the refrigerant loop downstream of the compressor is rejecting heat to ambient air, it is possible, in combination with the $CO_2$ refrigerant, to maximise the cooling effect in the heat sink comprising the ambient air heat exchanger, this cooling effect being achieved from the high $\Delta T$ part of the heat rejection phase during transcritical operation in the initial part of the heat rejection phase.

The ambient air heat exchanger permits a high threshold for de-superheating, and therefore permits a high proportion of the total sensible heat transfer for the cooling phase to be through the ambient air heat exchanger. Typically, up to about 60% of the total heat may be rejected through the ambient air heat exchanger and at least about 40% of the total heat may be rejected through the alternative medium heat exchanger.

As a comparison, when conventional refrigerants are used in conventional refrigeration apparatus, the maximum de-superheating, by initial sensible heat transfer (equivalent to line c to d of FIG. 5) is typically only up to about 20% of the total heat to be rejected.

FIG. 7 illustrates the upper section of such a transcritical refrigeration cycle for $CO_2$ refrigerant. The initial cooling phase experiences a high drop in pressure and has a high $\Delta T$ part of the heat rejection phase, identified as zone A, which correspondingly allows about 60% of the total heat to be rejected in the high $\Delta T$ part of the heat rejection phase during transcritical operation. In zone B, about 40% of the total heat to be rejected is in the low $\Delta T$ part of the heat rejection phase.

Furthermore, in the "summer mode" of the apparatus and method as discussed above in which the sequence of the heat exchangers in the loop is initial (upstream) ambient air heat exchanger and subsequent (downstream) alternative medium heat exchanger, the alternative medium heat exchanger would achieve more effective heat rejection through condensation of $CO_2$ after the $CO_2$ refrigerant has lost up to 60% of the heat to be rejected to the upstream ambient air heat sink. This arrangement provides a more effective use of an alternative cooling medium (such as a water-based liquid) as a high density resource of cooling of thermal energy by maximising the cooling effect in both stages. The sensible heat may be rejected to a medium of virtually unlimited type, such as ambient air, and latent heat may be rejected to available alternative media, such as water-based liquids.

As a result, the phase diagram of such a two stage heat rejection may be as illustrated in FIG. 8.

The provision of an optional check/pressure regulating valve can be implemented to ensure more reliable separation between the sensible and latent stages of such a heat rejection process where the alternative medium downstream heat exchanger 36 in FIG. 1 has a lower temperature state than the ambient air upstream heat exchanger 42. This check/pressure regulating valve maintains the pressure of the $CO_2$ refrigerant (line X-Y in FIG. 8) to a desired gas cooler outlet temperature at point Y in FIG. 8 during the initial transcritical region of the heat rejection phase. Additionally, a further pressure regulating valve may be provided at point Z to allow further reduction of the condensing temperature for specific design requirements such as refrigeration booster systems within the liquid area of the phase diagram. The additional work required for such a further reduction in condensing temperature would be provided by the compressor as in a typical transcritical designed $CO_2$ refrigerant system.

In the alternative sequence of heat exchangers discussed for the "winter mode", in which the alternative medium upstream heat exchanger 36 has a higher temperature state than the ambient air downstream heat exchanger 42, the sequence of $CO_2$ supply is no different from that used for other refrigerants (except that when the optional check/pressure regulating valve has been implemented, a bypass may be required around Point Y in FIG. 8) so that, as discussed above, the ambient air downstream heat exchanger 42 provides additional cooling and condensation of $CO_2$ in the alternative medium heat exchanger 36.

FIGS. 9, 10 and 11 schematically illustrate respective refrigeration cycle loops according to further embodiments of the present invention.

In each of FIGS. 9, 10 and 11, refrigeration cabinet(s) 100 is or are provided. A refrigerant loop 102 extends from an output side 104 to an input side 106 of refrigeration cabinet(s) 100 via plural heat exchangers. What differs between the loops of FIGS. 9, 10 and 11 is the number of heat exchangers, the position of the heat exchangers within the loop 102, and the particular selectively alternative loop configurations which change the order of the heat exchangers within the loop 102, and correspondingly the location within the loop of the various heat exchangers to the output side 104 or input side 106 of the refrigeration cabinet(s) 100.

In FIG. 9, in a first operation mode the corresponding loop configuration 108 serially connects the output side 104 to (i) the liquid phase heat sink heat exchanger(s) 110, such as one or more borehole heat exchangers, (ii) the ambient air heat exchanger(s) 112 and (iii) the input side 106. In a second operation mode the corresponding loop configuration 114 alternatively serially connects the output side 104 to (i) the ambient air heat exchanger(s) 112, (ii) the liquid phase heat sink heat exchanger(s) 110, and (iii) the input side 106.

In FIG. 10, the heat exchangers comprise liquid phase heat sink heat exchanger(s) 120, such as one or more borehole heat exchangers, ambient air heat exchanger(s) 122, one or more condensing heat exchangers 124 and one or more sub-cooling heat exchangers 126.

In a first operation mode the corresponding loop configuration 128 serially connects the output side 104 to (i) the one or more condensing heat exchangers 124 (ii) the one or more sub-cooling heat exchangers 126 and (iii) the input side 106. Additionally, in that loop configuration 128 there is a further first interconnected loop 130 between the one or more condensing heat exchangers 124 and the liquid phase heat sink heat exchanger(s) 120 and a further second interconnected loop 132 between the one or more sub-cooling heat exchangers 126 and the ambient air heat exchanger(s) 122.

In a second operation mode the corresponding loop configuration 134 still serially connects the output side 104 to (i) the one or more condensing heat exchangers 124 (ii) the one or more sub-cooling heat exchangers 126 and (iii) the input side 106. However, alternatively, in that loop configuration 134 there is a further first interconnected loop 136 between the one or more condensing heat exchangers 124 and the ambient air heat exchanger(s) 122 and a further second interconnected loop 138 between the one or more sub-cooling heat exchangers 126 and the liquid phase heat sink heat exchanger(s) 120.

In FIG. 11, the heat exchangers comprise liquid phase heat sink heat exchanger(s) 140, such as one or more borehole heat exchangers, ambient air heat exchanger(s) 142, one or more condensing heat exchangers 144 and one or more sub-cooling heat exchangers 146. Additionally, first and second intermediate heat exchangers 148, 150 are located in an intermediate loop 152, which connects to the main refrigerant loop 102, including the refrigeration cabinet(s) 100, via the one or more condensing heat exchangers 144 and one or more sub-cooling heat exchangers 146 commonly located in the main refrigerant loop 102 and the intermediate loop 152.

In a first operation mode the corresponding loop configuration 160 serially connects, via the main refrigerant loop 102, the output side 104 to (i) the one or more condensing heat exchangers 144 (ii) the one or more sub-cooling heat exchangers 146 and (iii) the input side 106, and also serially connects, via the intermediate loop 152, (a) the one or more condensing heat exchangers 144, (b) the first intermediate heat exchanger(s) 148, (c) the second intermediate heat exchanger(s) 150, (d) the one or more sub-cooling heat exchangers 146 and (e) back to the one or more condensing heat exchangers 144.

Additionally, in that loop configuration 160 there is a further first interconnected loop 170 between the first intermediate heat exchanger(s) 148 and the liquid phase heat sink heat exchanger(s) 140 and a further second interconnected loop 172 between the second intermediate heat exchanger(s) 150 and the ambient air heat exchanger(s) 142.

In a second operation mode the corresponding loop configuration 174 still serially connects, via the main loop 154, the output side 104 to (i) the one or more condensing heat exchangers 144 (ii) the one or more sub-cooling heat exchangers 146 and (iii) the input side 106, and also serially connects, via the intermediate loop 152, (a) the one or more condensing heat exchangers 144, (b) the first intermediate heat exchanger(s) 148, (c) the second intermediate heat exchanger(s) 150, (d) the one or more sub-cooling heat exchangers 146 and (e) back to the one or more condensing heat exchangers 144.

However, alternatively, in that loop configuration 174 there is a further first interconnected loop 176 between the first intermediate heat exchanger(s) 148 and the ambient air heat exchanger(s) 142 and a further second interconnected loop 178 between the second intermediate heat exchanger(s) 150 and the liquid phase heat sink heat exchanger(s) 140.

In each arrangement there is a loop, for cycling refrigerant or working fluid, having alternative configurations, but optionally additional interconnected loops may be provided, in conjunction with optional additional heat exchangers.

The embodiment of the present invention described herein are purely illustrative and do not limit the scope of the claims. For example, the two-way valves may be substituted by alternative fluid switching devices; and alternative modes of operation may be determined based on the particular characteristics of various alternative heat sinks.

Yet further, in additional embodiments of the invention, as modifications of the illustrated embodiments, the first heat exchanger system comprises a plurality of first heat exchangers and/or the second heat exchanger system comprises a plurality of second heat exchangers and/or the heat sink connection system further comprises at least one additional heat exchanger system adapted to be coupled to at least one additional heat sink within the fluid loop.

As described above, although the illustrated embodiment comprises a refrigeration system, the present invention has applicability to other thermal energy systems, such as heating systems. In such a heating system, the thermal system has a heating demand (rather than a cooling demand) and heat sources are provided (rather than heat sinks), and a vapour-compression heat pump cycle is employed rather than a refrigeration cycle.

Various other modifications to the present invention will be readily apparent to those skilled in the art.

The invention claimed is:

1. A thermal energy system comprising:

a first thermal system in use having a cooling demand; and a heat sink connection system coupled to the first thermal system, the heat sink connection system being adapted to provide selective connection to a plurality of heat sinks for cooling the first thermal system, the heat sink connection system including:

a first heat exchanger system adapted to be coupled to a first remote heat sink containing a working fluid, a second heat exchanger system adapted to be coupled to ambient air as a second heat sink, a fluid loop concurrently interconnecting the first thermal system, the first heat exchanger system and the second heat exchanger system, at least one mechanism for selectively altering the order of the first heat exchanger system and the second heat exchanger system in relation to a fluid flow direction around the fluid loop, and a controller for actuating the at least one mechanisms;

wherein the fluid loop has an input and an output connected to the first thermal system, and the at least one mechanism is adapted to be actuatable to switch the fluid loop between a first fluid loop configuration in which the first heat exchanger system is upstream of the second heat exchanger system in the direction of fluid flow around the loop from the input to the output and a second fluid loop configuration in which the second heat exchanger system is upstream of the first heat exchanger system in the direction of fluid flow around the loop from the input to the output.

2. The thermal energy system according to claim 1 wherein the first heat exchanger system is adapted to be coupled to a plurality of boreholes comprising the remote heat sink.

3. The thermal energy system according to claim 2 wherein the boreholes are comprised in a closed loop geothermal energy system.

4. The thermal energy system according to claim 1 wherein the second heat exchanger system is a condenser, gas cooler or sub-cooler coupled to ambient air.

5. The thermal energy system according to claim 1 further comprising a first temperature sensor for measuring the temperature of the first heat sink and a second temperature sensor for measuring the temperature of the second heat sink.

6. The thermal energy system according to claim 5 wherein the controller is adapted to actuate the at least one mechanism by employing the measured temperatures of the first and second heat sinks as control parameters.

7. The thermal energy system according to claim 6 wherein the controller is adapted to actuate the at least one mechanism at least partly based on a comparison of the measured temperatures of the first and second heat sinks.

8. The thermal energy system according to claim 1 wherein the heat sink connection system is configured to provide substantially unrestricted flow between the heat sinks.

9. The thermal energy system according to claim 1 wherein the first thermal system comprises a commercial or industrial refrigeration system which utilizes a vapour-compression Carnot cycle.

10. The thermal energy system comprising a commercial or industrial refrigeration system according to claim 9 which utilizes carbon dioxide as a refrigerant.

11. The thermal energy system according to claim 10 further comprising a first pressure regulating valve on a downstream side of the second heat exchanger system.

12. The thermal energy system according to claim 11 further comprising a bypass of the pressure regulating valve on the downstream side of the second heat exchanger system.

13. The thermal energy system according to claim 10 further comprising a pressure regulating valve on a downstream side of the first heat exchanger system.

14. The thermal energy system according to claim 1 wherein the at least one mechanism comprises a plurality of switchable valve mechanisms being actuatable for selectively altering the order of the first heat exchanger system and the second heat exchanger system in a fluid flow direction around the fluid loop.

15. The thermal energy system according to claim 14 wherein the controller is adapted simultaneously to actuate the plurality of switchable valve mechanisms.

16. The thermal energy system according to claim 1 wherein the first heat exchanger system comprises a plurality of first heat exchangers.

17. The thermal energy system according to claim 1 wherein the second heat exchanger system comprises a plurality of second heat exchangers.

18. The thermal energy system according to claim 1 wherein the heat sink connection system further comprises at least one additional heat exchanger system adapted to be coupled to at least one additional heat sink.

19. The thermal energy system according to claim 1 wherein the fluid loop serially interconnects the first thermal system, the first heat exchanger and the second exchanger system.

20. A method of operating a thermal energy system, the thermal energy system comprising a first thermal system, the method comprising the steps of:

(a) providing a first thermal system having a cooling demand, and a heat sink connection system coupled to the first thermal system, the heat sink connection system being adapted to provide selective connection to a plurality of heat sinks for cooling the first thermal system;

(b) providing a first heat exchanger system coupled to a first remote heat sink containing a working fluid;

(c) providing a second heat exchanger system to be coupled to ambient air as a second heat sink;

(d) flowing fluid around a fluid loop concurrently interconnecting the first thermal system, the first heat exchanger system and the second heat exchanger system to reject heat simultaneously to the first and second heat sinks; and (e) selectively altering the order of the first heat exchanger system and the second heat exchanger system in relation to a fluid flow direction around the fluid loop;

wherein the fluid loop has an input and an output connected to the first thermal system, and in step (e) switchable valve mechanisms connecting the first and second heat exchanger systems to the first thermal system are actuated simultaneously by a controller to switch the fluid loop between a first fluid loop configuration in which the first heat exchanger system is upstream of the second heat exchanger system in the direction of fluid flow around the fluid loop from the input to the output and a second fluid loop configuration in which the second heat exchanger system is upstream of the first heat exchanger system in the direction of fluid flow around the fluid loop from the input to the output.

21. A method according to claim 20 wherein step (e) is carried out by selectively switching valve mechanisms connecting the first and second heat exchanger systems into the fluid loop.

22. A method according to claim 21 wherein the valve mechanisms are two-way valves each having at least three ports.

23. A method according to claim 20 further comprising the step of measuring the temperature of the first heat sink and the temperature of the second heat sink and in step (e) the measured temperatures of the first and second heat sinks are employed as control parameters for controlling the order of the first and second heat exchanger systems in the fluid flow direction of the fluid loop.

24. A method according to claim 23 wherein the order of the first and second heat exchanger systems in the fluid flow direction of the fluid loop is controlled at least partly based on a comparison of the measured temperatures of the first and second heat sinks.

25. A method according to claim 20 wherein the first heat exchanger system is coupled to a plurality of boreholes comprising the remote heat sink.

26. A method according to claim 25 wherein the boreholes are comprised in a closed loop geothermal energy system.

27. A method according to claim 20 wherein the second heat exchanger system is a condenser, gas cooler or subcooler coupled to ambient air.

28. A method according to claim 20 wherein in the first fluid loop configuration the first heat exchanger system is arranged to provide primary cooling and condensing of the fluid and the second heat exchanger system is arranged to provide sub-cooling of the fluid.

29. A method according to claim 20 wherein the first fluid loop configuration is selected when a measured temperature of ambient air as the second heat sink is below a particular threshold in relation to a measured temperature of the working fluid of the first heat sink.

30. A method according to claim 20 wherein in the second fluid loop configuration the second heat exchanger system is arranged to provide primary cooling and condensing of the fluid and the first heat exchanger system is arranged to provide sub-cooling of the fluid.

31. A method according to claim 20 wherein the second fluid loop configuration is selected when a measured temperature of ambient air as the second heat sink is higher than a particular threshold in relation to the measured temperature of the working fluid of the first heat sink.

32. A method according to claim 20 wherein the first thermal system comprises a commercial or industrial refrigeration system applying the vapour-pressure Carnot cycle and employing carbon dioxide as a refrigerant.

33. A method according to claim 32 wherein in step (d) the carbon dioxide initially passes through the second heat exchanger system and rejects heat to the second heat sink under transcritical conditions without condensing the carbon dioxide in the second heat exchanger system.

34. A method according to claim 33 further comprising regulating the pressure of the carbon dioxide on a downstream side of the second heat exchanger system so as to provide a constant pressure during an initial heat rejecting phase of step (d).

35. A method according to claim 33 further comprising regulating the pressure of the carbon dioxide on a downstream side of the first heat exchanger system so as to provide a constant pressure during an second heat rejecting phase of step (d).

36. A method according to claim 20 wherein the first heat exchanger system comprises a plurality of first heat exchangers.

37. A method according to claim 20 wherein the second heat exchanger system comprises a plurality of second heat exchangers.

38. A method according to claim 20 further comprising providing at least one additional heat exchanger system coupled to at least one additional heat sink, the fluid loop interconnecting the first thermal system, the first heat exchanger system, the second heat exchanger system and the at least one additional heat exchanger system to reject heat simultaneously to the first and second heat sinks and to the at least one additional heat sink.

* * * * *